United States Patent [19]

Braswell et al.

[11] Patent Number: 4,739,366

[45] Date of Patent: Apr. 19, 1988

[54] REAL TIME DIAGNOSTIC SYSTEM FOR REPROGRAPHIC MACHINES

[75] Inventors: Charles D. Braswell, Rochester; Paul F. Schmitt, Palmyra, both of N.Y.

[73] Assignee: Xerox Corporation, Stamford, Conn.

[21] Appl. No.: 902,899

[22] Filed: Sep. 2, 1986

[51] Int. Cl.[4] ..... G03G 21/00

[52] U.S. Cl. ..... 355/14 SH; 355/14 C; 371/15

[58] Field of Search ..... 355/3 SH, 14 SH, 14 C, 355/14 R; 371/15; 364/525, 550, 569

[56] References Cited

U.S. PATENT DOCUMENTS

| | | | |
|---|---|---|---|
| 4,062,061 | 12/1977 | Batchelor et al. | 364/900 |
| 4,133,477 | 1/1979 | Marino et al. | 355/14 C X |
| 4,156,133 | 5/1979 | Legg | 355/14 C X |
| 4,249,080 | 2/1981 | Pritchett et al. | 250/557 |
| 4,268,746 | 5/1981 | Schroeder | 250/223 R |
| 4,305,653 | 12/1981 | Evanitsky | 355/8 |
| 4,335,949 | 6/1982 | Kukucka et al. | 355/3 R |
| 4,477,901 | 10/1984 | Braband et al. | 371/15 |
| 4,589,080 | 5/1986 | Abbott et al. | 364/552 |

*Primary Examiner*—Fred L. Braun

*Attorney, Agent, or Firm*—Mark Costello

[57] ABSTRACT

A reproduction machine for making copies from original documents includes a diagnostic system for examining the operation of the transport devices moving paper sheets through the paper path. Paper path sensors are located along the paper paths for sensing the passage of paper sheets as they are moved therethrough. A device clock generates information regarding the times of sheet passage past sensors. Data representative of machine operating time and corresponding to paper sheet passage past the sensors is stored in an addressable memory for a number of paper sheet passages. Upon indication of a fault condition, such as a paper jam, the data stored in the addressable memory is moved to a non-volatile memory. A device control and display are provided to access and manipulate the stored data.

12 Claims, 3 Drawing Sheets

REAL TIME DIAGNOSTIC SYSTEM FOR REPROGRAPHIC MACHINES

This invention relates primarily to reprographic machines, and more particularly to an improved paper path diagnostic system for use in such machines.

INCORPORATION BY REFERENCE

For the purpose of background information on paper path diagnostics the following patents are incorporated herein by reference: 4,062,061; 4,305,653; and 4,477,901.

BACKGROUND OF THE INVENTION

The maintenance of complex reproduction machines has become an increasingly important aspect in the commercial production and sale of such machines. As these machines grow larger, more complex, faster and more expensive, it has become increasingly important to take measures ensuring the machine's continued reliable operation. As these machines are indispensable to their users, an increasingly important feature of such machines is their reliability. When the machine does malfunction, it is desirable that it be fixed in as short a time as possible.

As a result of these needs, much work has been done to improve the on-board diagnostic capability of these machines. With such a machine capability, a service representative, or a trained user can easily and quickly determine the cause of the malfunction. In the case of a service representative, based on such a diagnostic report from the machine, action may be taken to effectuate an appropriate repair.

In the past, such diagnostic capability was restricted to use during a diagnostic mode of operation. In this type of system, as shown by U.S. Pat. No. 4,477,901, assigned to the same assignee as the present invention, a diagnostic system is provided for use by a service representative when the machine is not in a normal mode of operation. In such a system, the service representative can exercise certain diagnostic capabilities of the machine particularly related to the flow of paper through various paths of the machine to determine whether such paths are operating at the appropriate speed, while the machine is in a nonoperable mode. Alternatively, a limited examination of paper flow paths may be made on a real time basis demonstrating the events leading to a malfunction, as shown by U.S. Pat. No. 4,335,949, also assigned to the same assignee as the present application. This information is lost after the problem has been corrected and operation of the machine is resumed. Often, difficult and costly problems occur only on an intermittent basis, and are difficult to replicate. Accordingly, the service representative has no information to proceed from when asked to make adjustments on a service call.

In the same manner, U.S. Pat. No. 4,268,746 teaches comparing actual machine operation, i.e. paper passing times, with an ideal system, and creating an alarm when the system varies more than a selected amount from the ideal. Similarly, U.S. Pat. No. 4,249,080 teaches a system for comparing detected article movement with detected surface movement. Such systems provides for detection of failure events, but not for the factors leading up to the failure event so no corrective action may be taken based on the machine malfunction indications.

It is understood that the diagnostic system of the IBM Series 3 copiers, Models 30, 40 and 60, provides stored information for later retrieval regarding the location of paper jams occuring over time, as well as the source of paper causing the jam. This identifies the paper path which is potentially at fault, but tells a service representative nothing about the cause of the problem.

Xerox Disclosure Journal, Vol. 9, page 393, November/December 1984, discloses use of an adaptive algorithm for recirculating document handlers which entails using sensed document acquisition time and sensed document transport time to control the total time through the recirculating document handler. The acquisition and transport times described are sensed for each set of documents passed therethrough, and abnormalities can thus be detected.

None of the references teach a satisfactory way for a service representative to examine past successful operation of the paper paths as well as past fault operations to determine whether a problem is spontaneous or developing over time. The prior art methods of diagnostics have proven unsatisfactory in the area of preventive maintenance as previous systems have relied on the appearance of a malfunction of fault to begin the diagnostics operation, or require the service representative to work backwards from a fault to determine its source. It would therefore be desirable to provide a constant operation, real time diagnostics system, accessible at any time, and providing current operation information on a portion of the machine, as well as information on previous fault operation.

SUMMARY OF THE INVENTION

In accordance with the invention, there is provided an improved real time diagnostics system in a reproduction machine having a series of interrelated stations or cahins performing the functions required by such a machine, and including a paper path having transport devices for passing material as either source material or as copy material to appropriate stations in predetermined timed sequence for operation thereon. Sensors located along the paper paths detect paper passing thereby. Information regarding this passage is stored as a time based event in a device memory for access by an operator. Event information is stored for the passage of several sheets before deletion of the earliest recorded event informationin the memory. Recorded information may be accessed upon demand, either graphically or numerically, and in a fashion demonstrating the actual recorded operation of the device. Accordingly, a history of previous operating characteristics is available to the operator, showing past successful operations of the machine, in addition to possibly malfunctioning operation.

In accordance with another aspect of the invention, recorded information regarding previous operation of the device is stored in a device memory for subsequent retrieval and analysis upon the occurence of a preselected condition, such as a malfunction. This information may be stored in either a semi-permanent device storage element or on a removable recording medium for later examination.

In accordance with another aspect of the invention, a device controller is provided with optimum operating parameters for device operation against which a comparison of recorded event information may be made. With this comparison, action may be taken to adjust machine operating parameters to avert potential malfunctions of the device resulting from gradual changes in the machine operation caused by part wear, dirt, or other factors preventing machine performance on a factory designed level, but not yet causing malfunctioning operation.

It is therefore a primary object of the present invention to provide an integral real time diagnostic system for the paper path of a xerographic reproduction machine, continuously operable, and providing historical operation information on a monitored portion of the machine in a manner demonstrating successful operaton of the device, as well as malfunctioning operation.

It is a further object of the present invention to provide a continuously operable paper path monitor monitoring paper path operational values during normal operation thereof.

It is yet a further object of the present invention to monitor and store the characteristics of operation of a selected portion of a xerographic machine from which a history of operation thereof may be derived.

It is still a further object of the present invention to provide a diagnostics system in a xerographic machine provided with stored optimum operating parameters against which actual operating characteristics may be compared for a determination of repair or adjustment requirements.

These and other objects and advantages will become apparent as the following description is reviewed in conjunction with the accompanying drawings in which.

Figure 1:
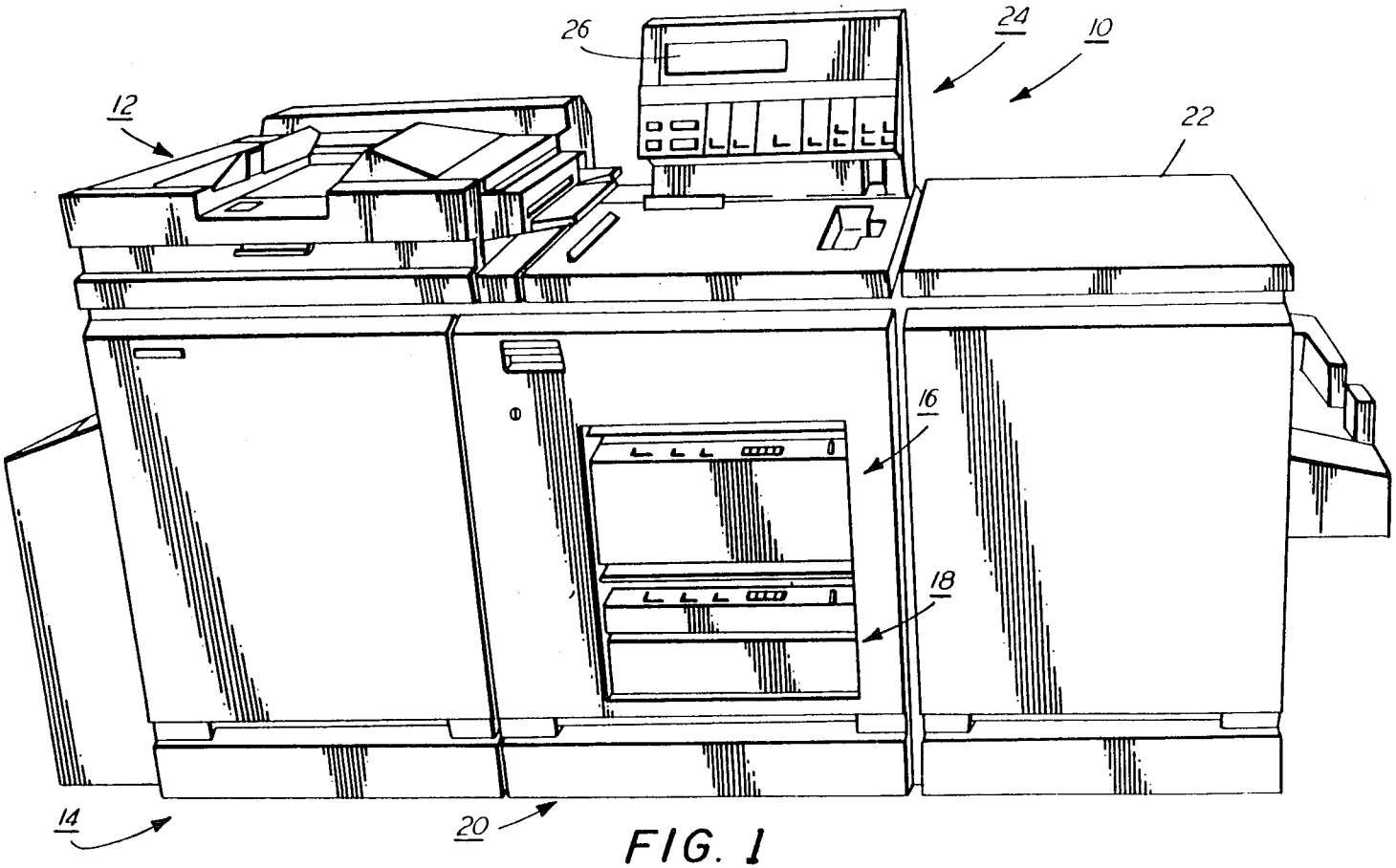
FIG. 1 is a perspective view of a reproduction machine of the type contemplated to use the present invention.

Referring now to the drawings, wherein the showings are for the purpose of illustrating a preferred embodiment of the invention and not for the purpose of limiting same, FIG. 1 shows a perspective view of a reproduction machine as contemplated by the present invention. Reproduction machine 10 may include recirculating document handler 12, for advancing documents to be copied to the appropriate positionsin processing module 14, where the reproduction processes are performed. Copy paper stock is advanced from copy sheet holding trays 16 and 18 through the copy sheet module 20 to the processing module 14 for operation thereon. The resultant copies may then be transported to a finishing module 22 where such steps as collation, compilation, stapling, or binding may take place. Control panel 24, with display screen 26, allows the machine operator to select the various options available int he device, to start and stop copying operations and to otherwise program the machine operation. Display screen 26, in conjunction with control panel 24, allows the operator to view the selected machine conditions as well as certain control aspects of the device.

Figure 2:
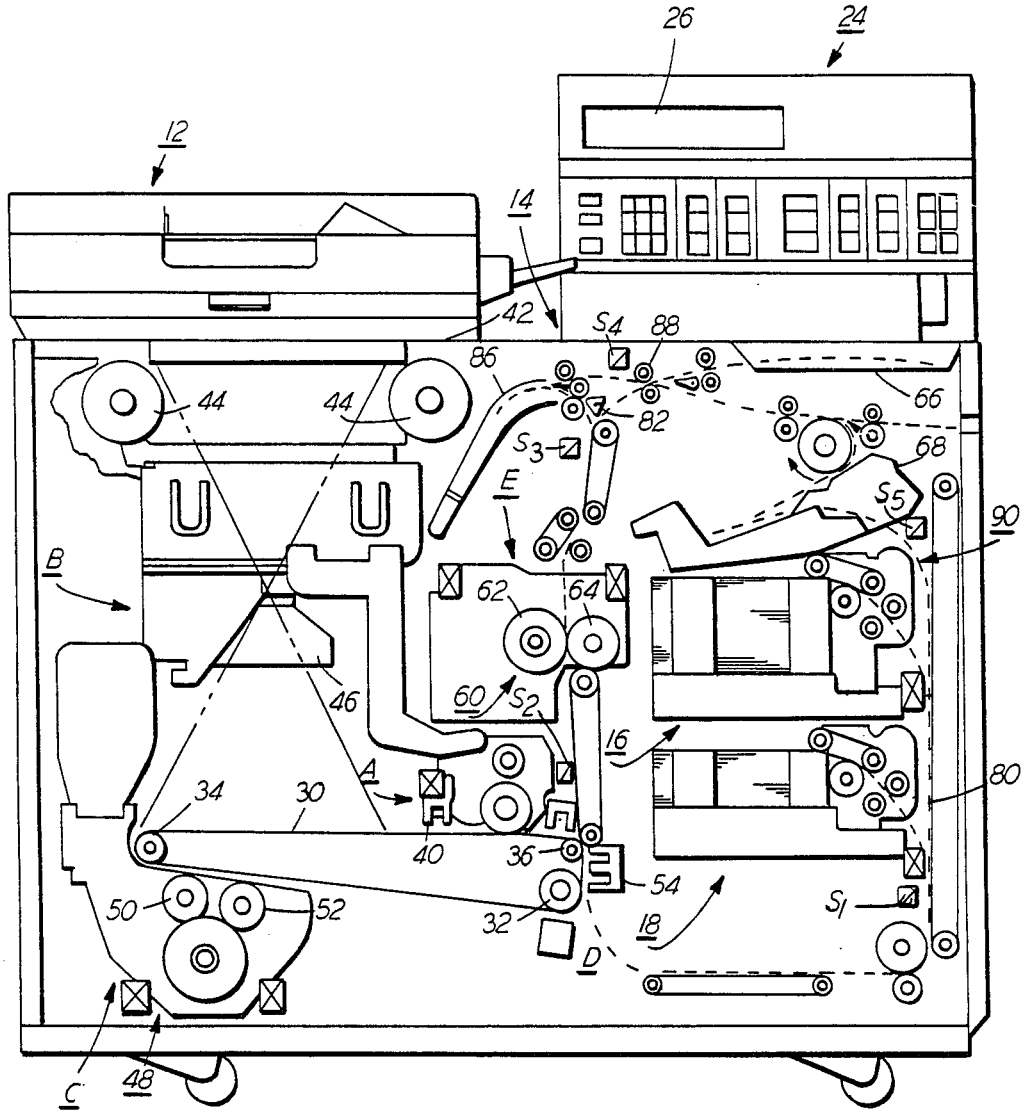
FIG. 2 is a somewhat schematic view of a paper path in accordance with the present invention.

FIG. 2 shows, somewhat schematically, the general operating arrangement of a reproduction machine of the type contemplated. Module 14 is provided with belt 30 having a photoconductive surface deposited on a conductive substrate. Belt 30 is advanced by and about driving roller 32, tensioning roller 34 and stripping roller 36. Successive portions of the photoconductive surface of belt 30 are thereby advanced through processing stations sequentially arranged about the path of belt 30.

To begin the copying process a portion of belt 30 passes through charging station A, where a corona generating device 40 charges the surface of belt 30 to a relatively high uniform potential.

After the surface of belt 30 is charged, the charged portion thereof is passed through exposure station B. At exposure station B, a document to be copied is advanced onto a transparent platen 42 by the recirculating document handling system 12. Lamps 44 illuminate the document. Light rays reflected from the illuminated document are transmitted through lens 46 forming a light image thereof. The lens 46 focuses the light image on the photoconductive surface of the belt 30 to selectively dissipate the charge thereon. An electrostatic latent image is recorded on the photoconductive surface which corresponds to the informational areas contained within the original document.

After the electrostatic image is recored on the photoconductive surface of belt 30, that portion of the belt holding the image is advanced to development station C. At development station C, magnetic brush development system 48 advances developer material into contact with the latent image on belt 30. Preferably, magnetic brush development system 48 includes magnetic brush development rollers 50 and 52. Each roller advances developer material into contact with the latent image. Rollers 50, 52 form a brush of carrier granules and toner particles extending outwardly therefrom. The latent image attracts the toner forming a toner powder image on the latent image.

After development, the image carrying portion of belt 30 advances to transfer station D. A copy sheet, such as paper, transparency, etc., is advanced from the copy sheet module 20. Transfer station D includes a corona generating device 54 which sprays ions onto the backside of the copy sheet. This attracts the toner particles from the photoconductive surface of belt 30. After transfer of the toner material to the copy sheet it is moved to fuser station E.

Fuser station E includes a fuser assembly 60 for permanently affixing the transferred toner powder onto the copy sheet. Fuser assembly 60 comprises a heated fuser roller 62 and backup roller 64. The copy sheet is passed between fuser roller 62 and backup roller 64 with the toner powder image on the copy sheet contacting the fuser roller. In this manner, the toner powder image is permanently affixed to the copy sheet. After fusing, the copy sheet is advanced to eithe ran output tray 66 or a duplex tray 68 for second side copying, or to finishing module 22 where additional operations may be performed thereon. Reproduction copying in the manner described above is well known, and does not form a part of the present invention.

In accordance with the invention, photoelectric or pressure sensitive sensors may be arranged at predetermined locations along the paper paths of the recirculating document handler or the copy sheet transport devices. By way of example, photoelectric sensors S1, S2, S3, S4, and S5 may be located along the paper path of the copy sheet transport devices at locations proximate to copysheet tray conveyor 80 carrying copying sheets outwardly from copy sheet trays 16 and 18, at the conveyor carrying copy sheets to fuser 60, at the selector gate 82, passing the paper to either of inverter 86, or to output 66, at the output tray nip 88 or at duplex tray output 90. It will be appreciated that many more sensors of various types may be used in a wide variety of locations, either in the reproduction processing module 14 or in any or the other modules.

Figure 3:
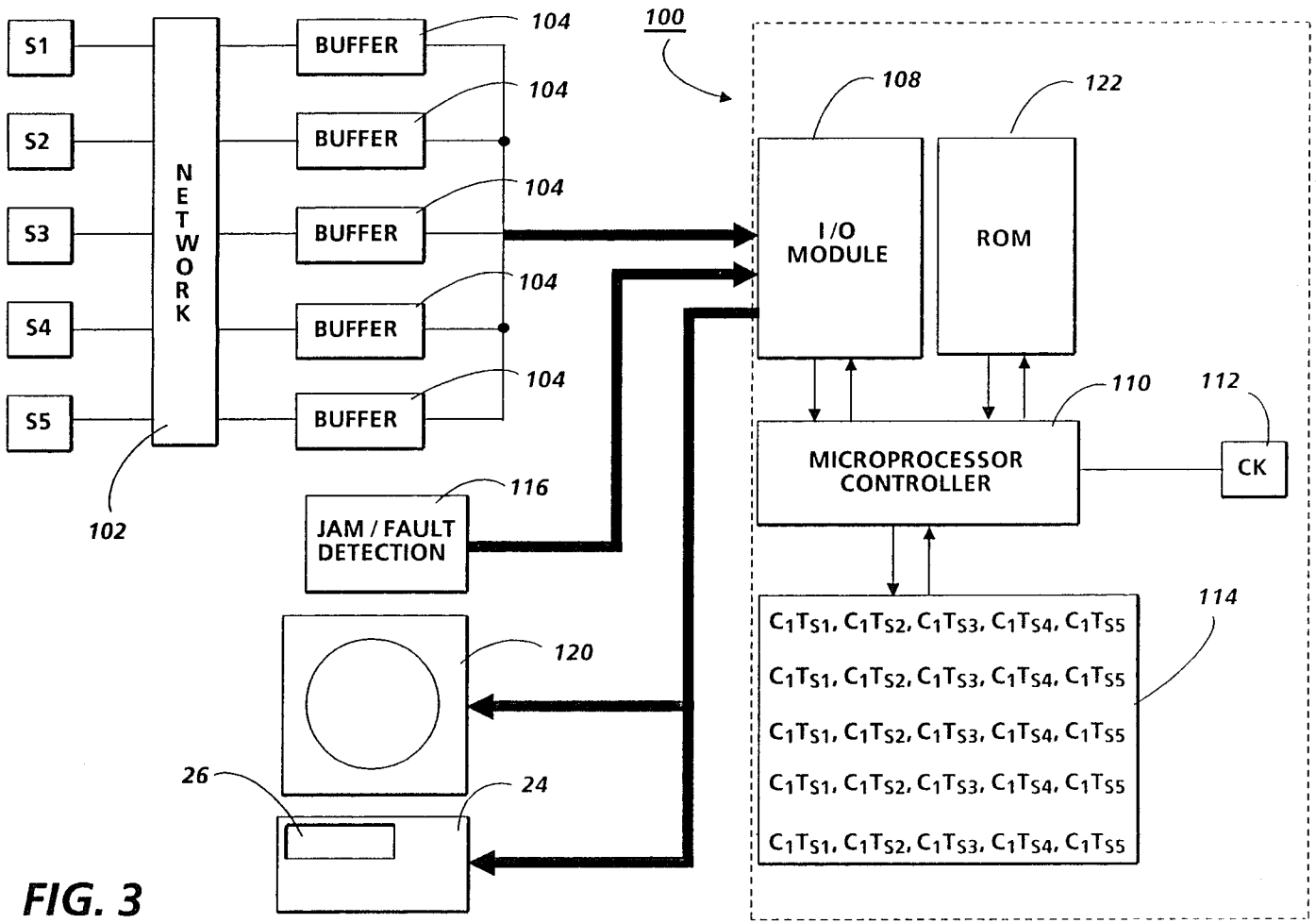
FIG. 3 is a block diagram showing the operational elements of a preferred embodiment of the present invention.

Referring now to FIG. 3, as a copy sheet passes by any of sensors S1–S5, its presence is detected, and a signal is sent to reproduction controller 100. Reproduction controller 100 also conventionally provides for storage and comparisons of counted values including copysheets and documents, and numbers of desired copies; and control of operations selected by an operator through control panel 24 and display screen 26, as is well known in the art. Signals from the sensors are passed via resistance network 102 through buffer 104 to an input/output (I/O) stage 108 of reproduction controller 100. Microprocessor 110 including clock 112 is provided in controller 100 for the general control of the reproduction machine systems. In response to a signal from any of sensos S1–S5, received by microprocessor 110 through I/O stage 108 from clock 112, data representative of the time at which a copy sheet passes the sensor is loaded into addressable device memory 114. Subsequent data, representative of the times at which succeeding copy sheets pass successive sensors, is loaded into sequential memory addresses. If desired, the data directed to addressable memory 114 may be arithmetically manipulated by microprocessor 110 before storage to produce differential time information, e.g. the time that a copy sheet took to pass between two predetermined sensors, or time values reflecting the period from the start of a particular copying operation.

The timing data is stored in addressable device memory 114 of controller 100 at sequential addresses in an array relating particular copy sheets to the times of passage past particular sensors. In accordance with the invention, this information is stored and continuously updated in addressable memory 114. In practice, it is contemplated that information will be stored for a predetermined number of copy sheets, approximately 5–10 at a time. The array is updated in either a stacking or circulating fashion, deleting the oldest information on receipt of newer information. This information is accessible via the control panel 24 for display on display 26 and may be accessible in either operating, quiescent or diagnostic modes. Accordingly, an operator may view dynamic operation or past history of operation.

In accordance with another aspect of the invention, the stored array values are directed from addressable device memory 114 to nonvolatile memory means on the occurrence of a fault condition detected by system fault or jam detectors 116. As shown in FIG. 3, addressable device memory 114 is connected through microprocessor 110 to a nonvolatile memory means, such as disk storage device 120. Disk storage device 120 may be either a hard or floppy disk storage device of a type well known in the art of data storage. In a preferred embodiment, floppy disk storage may be provided to enable stored data to be removed from the machine and reviewed at remote locations. It will a lso be appreciated that information stored at disk storage device 120 is operator accessible via control panel 24 for display on display 26.

Data stored at addressable memory 114 is passed to the disk storage device 120 on the occurrence of a fault condition generated at the jam/fault detection system 116. A signal indicative of a fault or jam condition, or data interpreted as a fault or jam condition, is passed through I/O module 108 to microprocessor controller 110. It will be appreciated that the detection of machine malfunctions, and the generation of fault signals in response thereto is well known in the art as shown by the aforementioned U.S. Pat. No. 4,477,901, incorporated herein by reference. On detection of a signal from the fault/jam detection system 116 indicating a problem, microprocessor controller 110 directs the current data stored in addressable device memory 114 to disk storage device 120. At this point all values are reset and the sensing operation is recommenced on continued operation of the machine.

The controller 100 may additionally be provided to have in memory, either in a hard disk, floppy disk, or in a device memory such as read only memory (ROM) 122, a set of stored values indicative of optimum operation of the paper path transport system. In this case, the stored values may be retrieved from the ROM 122 and reviewed at display 26. It will be appreciated that this information may include either the machines historical operating characteristics, thus showing the distinctive aspects of a particular machines operation, or factory specified values for comparison with sensed operating parameters of the device stored either at addressable device memory 114 or disk storage device 120. Arithmetic manipulation may be available through microprocessor 110 to compare sensed values with stored values thereby displaying the differences or errors in actual operation when compared to ideal operation.

The invention has been described with reference to a particular embodiment. Modifications and alterations will occur to others upon reading and understanding this specification. It is intended that all such modifications and alterations are included insofar as they come within the scope of the appended claims or equivalents thereof.

What is claimed is:

1. A reproduction machine for making copies from original documents having at least a first paper path through which sheets of paper are passed by transport devices during reproduction operations to various stations in said machine for operation thereon, and a diagnostic system for examining the operation of said transport devices moving said sheets through said paper path, said diagnostic system comprising:

paper path sensing means located along said paper paths for sensing the passage of paper sheets as they are moved therethrough;

clock means for generating data representative of machine operating time;

addressable memory means for storing data representative of machine operating time and corresponding to paper sheet passage past said sensing means for each of a preselected number of paper sheet passages, said addressable memory means continuously updated, deleting old sheet passage data and storing current sheet passage data to maintain said sheet passage data for said preselected number of paper sheet passages;

fault detection means for detecting a fault condition;

non-volatile memory means for storing said sheet passage data corresponding to said preselected number of paper sheet passages on receipt thereof from said addressable memory means upon detection of a fault condition by said fault detection means; and means for selectively accessing said memory containing said time representations of said sheet passage.

2. The diagnostic system as described in claim 1 including reference memory means for storing data representative of paper passage past said paper path sensors and indicative of optimun operation of said transport devices; means for selectively accessing said optimum operation data; and means for selectively displaying said optimum operation time representations.

3. The diagnostic system as defined in claim 1 and including reference memory means for storing data representative of paper passage past said paper path sensors indicative of optimum operation of said transport devices; comparator means for comparing said stored optimum operation data with said sensed data; and means for selectively displaying said comparison of said optimum and said sensed data.

4. The diagnostic system as defined in claim 3 wherein said comparison comprises the difference value between said optimum and said sensed data.

5. The diagnostic system as described in claim 1 and including display means for displaying said data representative of machine operating time and corresponding to paper sheet passages in operator readable format.

6. The diagnostic system as defined in claim 1 and including disk memory storage means for storing said data representative of machine operating time and corresponding to paper passage.

7. The diagnostic system as defined in claim 6 wherein said disk memory storage means includes storage media removable from said disk memory storage means for recording said data representative of machine operating time and corresponding to paper passage thereon, whereby said recorded data may be examined remotely from said diagnostic system.

8. The diagnostic system as defined in claim 7 wherein said fault condition includes malfunction of said transport devices.

9. A method for examining the operation of a reproduction machine having at least a first paper path for circulating paper sheets therethrough and including paper path sensors along said paper path, including the steps of:

a. sensing passage of a paper sheet past paper path sensors;

b. storing information regarding the time of paper sheet passage past said paper path sensors in an addressable memory for a plurality of paper sheets, whereby information is stored for an series of operations of said reproduction machine;

c. continuously updating said information by deleting sheet passage information for the oldest sheet passage and adding information rgarind the most recent sheet passage; and d. moving said stored information from said addressable memory to a long term storage device on an occurrence of a preselected condition.

10. The method as defined in claim 9 and including the step of displaying said information upon operator request.

11. The method as defined in claim 9 and including the step of providing optimum operation parameters in the form of ideal values for said time representations in a read only memory device, accessible upon an operator request, whereby the detected information may be directly compared to said ideal values.

12. The method as defined in claim 9 wherein said stored information is recorded on removable storage media upon the occurrence of a preselected condition, and deleted from said addressable memory thereof.

* * * * *